United States Patent [19]

Carol, Jr. et al.

[11] 4,001,776

[45] Jan. 4, 1977

[54] MULTIPLE INDICATION DISPLAY

[75] Inventors: John A. Carol, Jr.; Raymond J. Peterson, both of Flint, Mich.

[73] Assignee: General Motors Corporation, Detroit, Mich.

[22] Filed: Aug. 4, 1975

[21] Appl. No.: 601,596

[52] U.S. Cl. ..... 340/52 F; 340/324 R; 340/373; 340/378 R; 340/412

[51] Int. Cl.[2] ..... G08B 19/00

[58] Field of Search ..... 340/52 F, 52 R, 213 R, 340/266, 412, 414, 415, 324 R, 373, 378 R, 378 E, 379

[56] References Cited

UNITED STATES PATENTS

| | | | |
|---|---|---|---|
| 3,503,067 | 3/1970 | Amiragoff | 340/412 |
| 3,660,814 | 5/1972 | Fales | 340/52 F |
| 3,839,701 | 10/1974 | Pomerantz | 340/52 F |

*Primary Examiner*—Alvin H. Waring
*Attorney, Agent, or Firm*—Warren D. Hill

[57] ABSTRACT

A plurality of on/off sensors each register the occurrence of an event in a system while other sensors measure the value of certain conditions in the system and include detectors for indicating when any measurement attains a predetermined value. An actuating circuit responsive to the on/off sensors and to the detectors controls a display device which presents to a display location a message corresponding to an on/off sensor and an indicia corresponding to a measured condition. A meter has an indicator at the display location for registration with the indicia. The actuating circuit in response to detection of a measured condition of predetermined value selectively connects the sensor measuring that condition to the meter so that the indicator registers with the displayed indicia to indicate the value of the condition.

4 Claims, 7 Drawing Figures

MULTIPLE INDICATION DISPLAY

This invention relates to a multiple indication display to display singly indications of any one of a number of conditions or events and more particularly to such a display automatically displaying one of several indicia for a meter giving the value of a measured condition.

In motor vehicles it is customary to provide information to the vehicle operator about the status of various vehicle parameters by telltale messages which merely indicate the occurrence of an event or by meters which indicate the value of a condition. When it is desired to provide such information for a very large number of events of parameters, the number of such information displays may become prohibitively large from the standpoint of operator viewing of all the indicators or crowding of the available instrument panel area. It is thus desirable to provide information on different parameters one at a time at a single display location.

It is therefore a general object of this invention to provide a display system for displaying one at a time several indicia for cooperation with a meter indicator to indicate the value of a measured condition automatically on the condition attaining a predetermined value..

A further object is to provide in such a system messages at the display location concerning events detected by on/off sensors.

The invention is carried out by providing a sensor to measure each of a number of conditions simultaneously and elements responsive to each sensor to detect when any condition reaches a predetermined value, a plurality of indicia selectable for display in response to an element detecting a predetermined value, and a circuit for energizing a meter to indicate with the indicia the value of the specific condition.

The invention is further carried out by providing a display unit which provides not only the indicia for the meter but also messages related to the occurrence of events sensed by on/off sensors wherein the circuit automatically selects those messages for display as well as the indicia.

The above and other advantages will be made more apparent from the following specification taken in conjunction with the accompanying drawings wherein like reference numerals refer to like parts and wherein.

Figure 1:
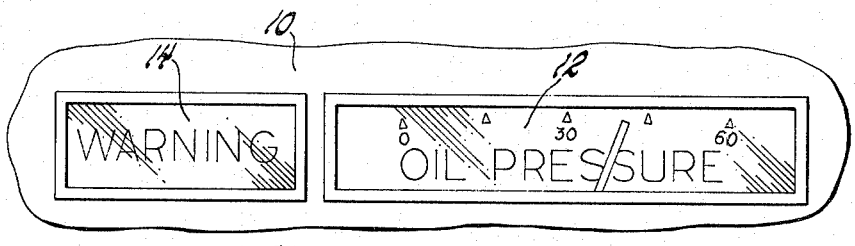
FIG. 1 is an illustration of the display area of a vehicle dash for providing an indication on an event or condition.
Figure 2:
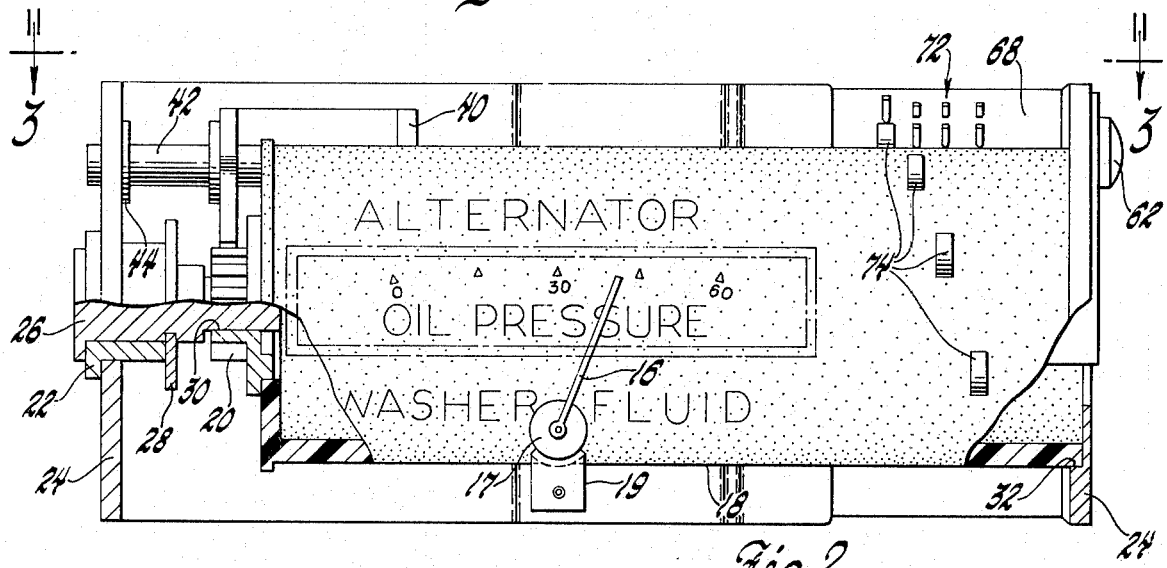
FIG. 2 is a front view of a rotary display device according to the invention for presenting indicia and messages to the display area.
Figure 3:
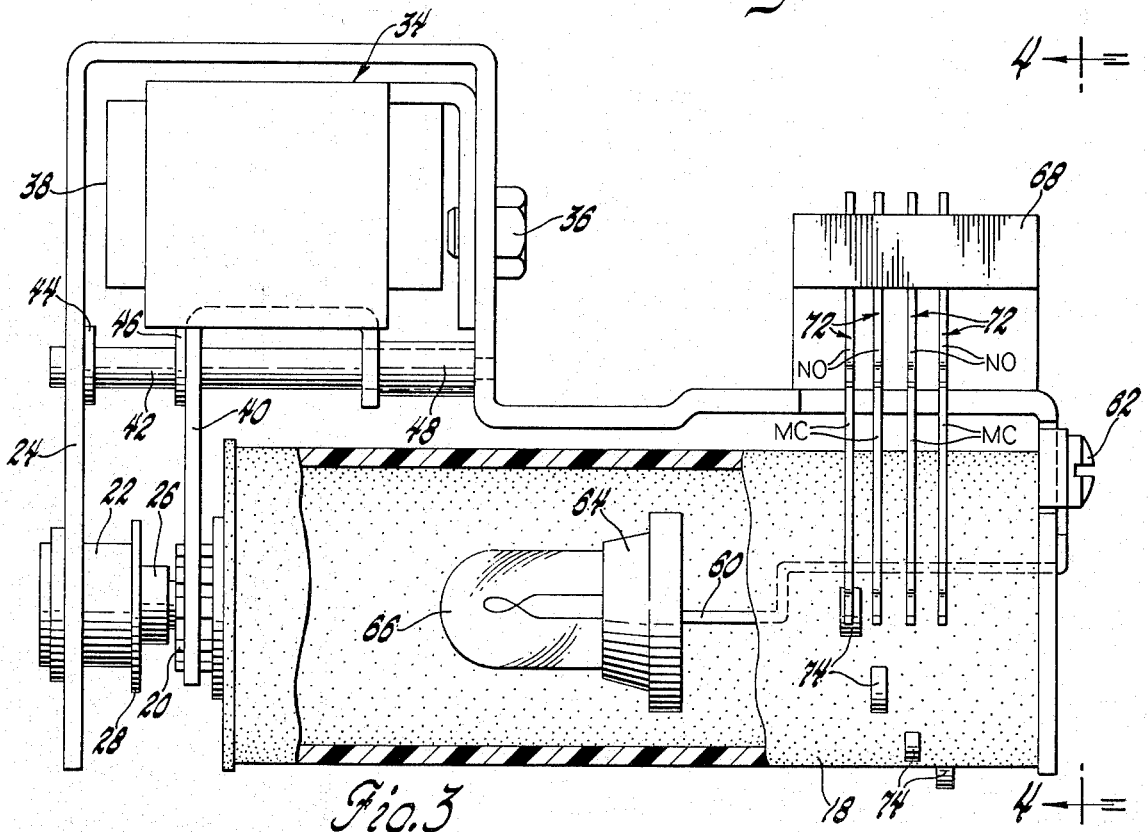
FIG. 3 is a drawing of the rotary display device as viewed along lines 3—3 of FIG. 2.
Figure 4:
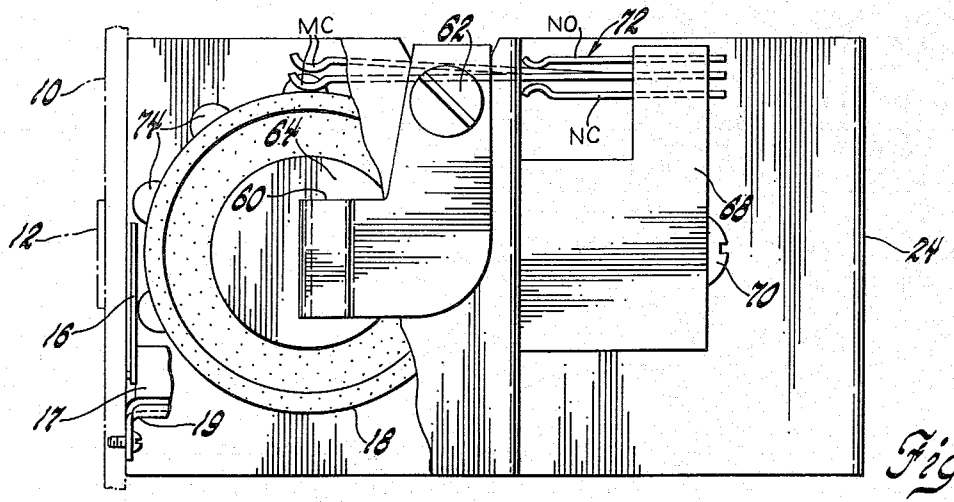
FIG. 4 is a drawing of the rotary display device as viewed along lines 4—4 of FIG. 3.

FIG. 1 shows a portion 10 of an instrument panel, a display window 12 and a telltale window 14 having "warning" printed thereon. Referring to FIGS. 2 through 4, the vehicle display system includes a translucent and insulating drum 18 having a plurality of messages such as ALTERNATOR and WASHER FLUID and in addition having a plurality of indicia for indicating, for example, oil pressure or coolant temperature in conjunction with a pointer 16 driven by a meter movement 17 such as an air core gage. Thus, the messages on the drum 18 represent two types of sensed parameters: on/off events which are signalled to the operator merely by displaying a telltale message, and a condition being measured throughout a wide range, which is indicated to the operator by a meter or gage. A toothed driven member 20 is secured in a concentric relationship to one end of the drum 18. Sleeve 22 extends through and is secured to a bracket 24. A pin 26 extends through the sleeve 22 and the driven member 20 and is laterally secured by a holding ring 28 in a groove in the pin 26. The interface between the driven member 20 and the pin 26 forms a bearing surface 30 which rotatably supports one end of the drum 18. The other end of the drum 18 extends into a circular recess in the bracket 24 with the interface therebetween forming a second bearing surface 32 which rotatably supports the drum 18.

The drum 18 is rotated by a motor 34 which is secured to the bracket 24 by a fastener 36. The motor 34 includes a solenoid 38 and an armature 40, the armature 40 being pivotally connected to the bracket 24 by a pin 42. The pin 42 and the armature 40 are laterally secured by a pair of holding rings 44 and 46 and a sleeve 48. The details of the structure and operation of the drum drive are shown in the U.S. Pat. to Pomerantz No. 3,839,701.

Each time the solenoid is energized, the drum 18 is indexed through an angle to rotate one message or indicia from the window to position the next message or indicia adjacent the window. The bracket 24 with the attached drum 18 and drive motor 34 is mounted in any conventional manner within the vehicle behind the dash 10 and adjacent the viewing window 12 so that the messages on the drum 18 are observable by the vehicle operator through the viewing window 12. The meter 17 is secured by a bracket 19 to the dash 10 beneath the window 12.

A lamp holder 60 is secured to the bracket 24 by a screw 62 and extends into the drum 18 through an opening in the bracket 24. A lamp socket 64 is attached to the lamp holder 60 and carries a legend lamp 66 which, when energized, illuminates the message on the drum 18 which is positioned adjacent the viewing window 12.

A terminal block 68 is secured to the bracket 24 by a screw 70 and carries a plurality of switches 72, the number of switches 72 being equal to the number of messages spaced around the drum 18. Each of the switches 72 is associated with a respective one of the messages on the drum 18 and includes a normally closed contact NC, a normally open contact NO and a movable contact MC normally engaging the normally closed contact NC. the movable contact MC of each of the switches 72 extends from the terminal block 68 and engages the surface of the drum 18 while also engaging the normally closed contact NC.

Figure 5:
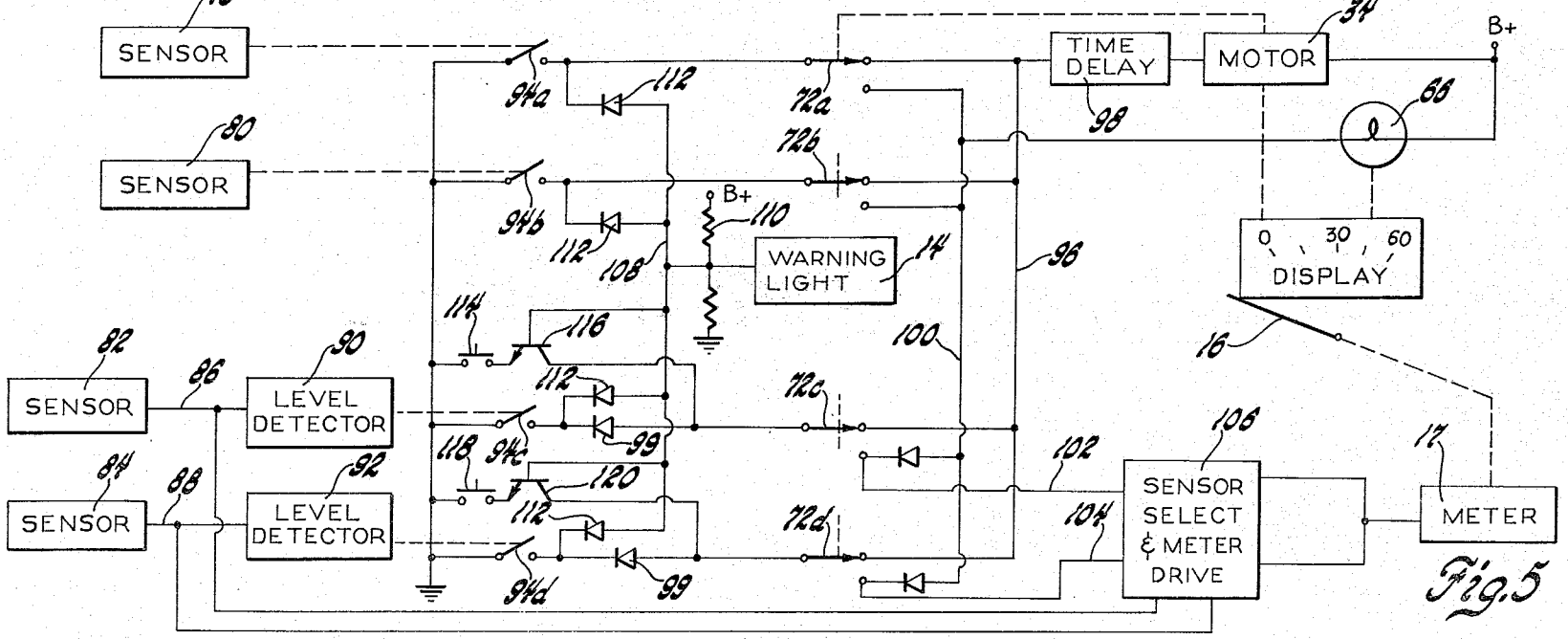
FIG. 5 is a schematic circuit showing the control for the rotary display device according to the invention.

Four switches 72 are shown corresponding to the four messages and indicia required for the simplified circuit of FIG. 5, however, a larger number of messages or indicia obviously may be utilized.

A plurality of cams 74 are carried on the surface of the drum 18 at unique angular positions. The relative position of the cams 74 and the movable contact MC of the switches 72 are such that when the drum 18 is rotated, the movable contact MC of each of the switches 72 is moved from engagement with the normally closed contact NC of said switch and into engagement with the normally open contact NO thereof when the message with which said switch 72 is associated is positioned adjacent the viewing window 12.

In FIG. 5, a pair of on/off sensors 78 and 80 are arranged to monitor events such as washer fluid level for which a simple talltale message is sufficient. Two other sensors 82 and 84 measure conditions and provide on lines 86 and 88, respectively, electrical signals proportional to the conditions being measured. Those conditions may be oil pressure or battery voltage, for example, for which it is desirable to have a readout indicating the value of the condition. Level detectors 90 and 92 are responsive to the signals on lines 86 and 88, respectively, and are activated when the respective signals reach a predetermined value, preferably a value which is indicative of abnormality. An actuating circuit contains normally open switches 94*a*, 94*b*, 94*c* and 94*d* which are closed upon actuation of sensors 78 and 80 are detectors 90 and 92, respectively. Each of the switches 94 is connected through normally closed contacts of switches 72*a*, 72*b*, 72*c* and 72*d* to line 96 which in turn is connected through a time delay circuit 98 and the motor 34 to a voltage source B+. Diodes 99 are positioned between switches 94*c* and 94*d* and switches 72*c* and 72*d*, respectively. The normally open contacts of the switches 72 are connected to line 100 which in turn is connected through the display lamp 66 to the voltage source B+. Normally open contacts 72*c* and 72*d* are further connected by lines 102 and 104 to a sensor select and meter drive circuit 106 which serves to energize the meter 17 according to the value of the signal on line 86 or 88 which will be selectively connected with the meter 17 according to whether switch 72*c* or 72*d* is operated. The warning light 14 is connected to a line 108 which is at the midpoint of a voltage divider 110 extending from B+ to ground. The box representing the warning light 14 further includes circuitry which insures that the warning light is on only when the line 108 drops to a low potential. Line 108 is connected through diodes 112 to the lines spanning the switches 94 and 72.

In operation, assume that an event occurs which activates sensor 80 thereby closing the switch 94*b* and that the other switches 94*a*, *c* and *d* remain open. Then current will flow from B+ through the motor 34, the time delay 98, normally closed contact switch 72*b*, and switch 94*b* to ground. Simultaneously the voltage on line 108 drops to turn on the warning light 18 thereby alerting the operator that some event or condition deserving his notice has occurred. The time delay 98 periodically interrupts the current through the motor so that the motor in effect is pulsed to index the display drum 18. As the drum 18 is indexed, the switches 72 are sequentially operated and indexing continues until the switch 72*b* is operated. Then the motor energizing current is interrupted and the lamp 66 is illuminated by the closure of a normally open contact of switch 72*b* thereby displaying a message which corresponds to the sensor 80. If no other switch 94 is operated, the displayed message will remain on as long as the event sensed by sensor 80 prevails. If, however, another event or condition occurs to cause the closure of another switch 94, that closure will likewise cause indexing actuation of the motor to advance the display position of the drum until the message or indicia appropriate to the second event is displayed in the window 12. The display will remain in the new condition for a period determined by the time delay circuit 98 and then the motor will be actuated to advance the display 12 to the previous message and this process is repeated so that the displayed information alternates between the two messages or indicia. Sensor 82 like sensor 84 continuously monitors the value of some condition and provides on line 86 a signal proportional to the condition and if that signal reaches some predetermined value indicative of an abnormality or critical condition then switch 94*c* is closed. In the manner described above the motor 34 is actuated to index the display drum until the contacts 72*c* are actuated to close the normally open contact thereby stopping the motor 34 and grounding line 102. Then the meter indicia related to the sensor 82 is displayed in the window 12. The sensor select circuit 106 connects the line 86 with the meter 17 so that the meter indicator 16 is driven to a position in the window 12 relative to the indicia to thereby show the value of the condition.

In order to manually select a meter reading for a desired condition, a manually operated switch 114 is connected between ground and the emitter of a transistor 116, the collector of which is connected to the switch 72*c*. The base of the transistor 116 is connected to the line 108. Then so long as none of the switches 94 are closed, the line 108 will have a high potential and transistor 116 will conduct upon manual closure of switch 114 causing advancement of the display drum until switch 72*c* is operated in the same manner as if the switch 94*c* had been closed. When, however, one of the switches 94 is closed, the potential of line 108 drops to render the transistor 116 non-conductive. Thus, the automatic display selection function of the circuit overrides the manual selection feature. Similarly, manual switch 118 and transistor 120 are provided to manually select a display corresponding to the sensor 84.

Figure 6:
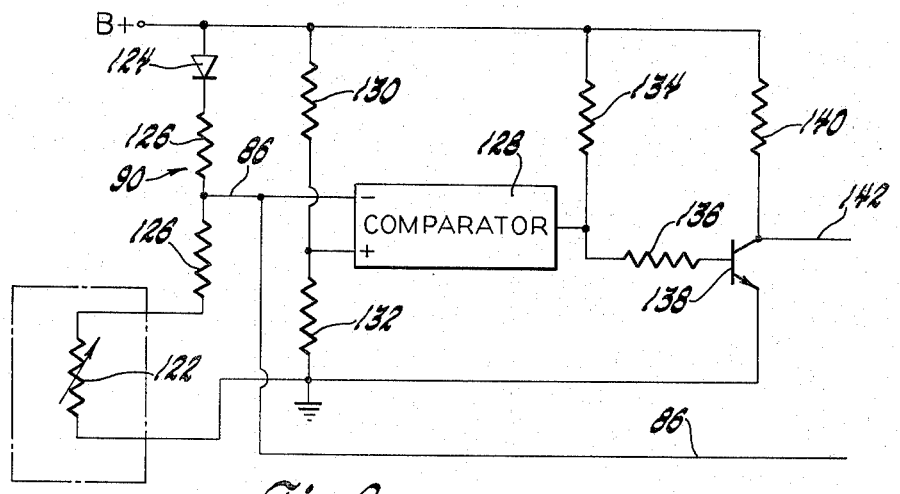
FIG. 6 is a schematic diagram of a sensor and detector of FIG. 5.

FIG. 6 shows schematically a typical sensor for monitoring oil pressure which includes a variable resistor 122, and a level detector 90 for sensing a predetermined oil pressure level signal. The circuit includes voltage source B+ which is connected through a diode 124, a pair of calibrating resistors 126 and through the variable resistor 122 to ground. The junction point of the calibrating resistors 126 is connected to line 86 which in turn is connected to the negative input of a comparator 128. A voltage divider comprising resistors 130 and 132 between B+ and ground provides a reference voltage at the positive input of the comparator 128. The comparator output is connected through resistor 134 to B+ and resistor 136 to the base of the transistor 138. The transistor emitted is grounded and its collector is connected through resistor 140 to B+ and is also connected to an output line 142. When the oil pressure is in a normal range, the voltage at the negative input of the comparator will exceed that of the positive input so that the output will be of low potential which keeps the transistor 138 biased off so that a high voltage appears on line 142. When, however, the oil pressure falls to some level determined by the voltage divider 130, 132 indicative of an undesirable or abnormal condition, then the comparator output will switch to a positive value to turn on transistor 138 and thereby essentially connect line 142 to ground. Transistor 138 in effect is the switch 94*c* of FIG. 5 and a line 142 is connected through the diode 99 to the switch 72*c*.

Figure 7:
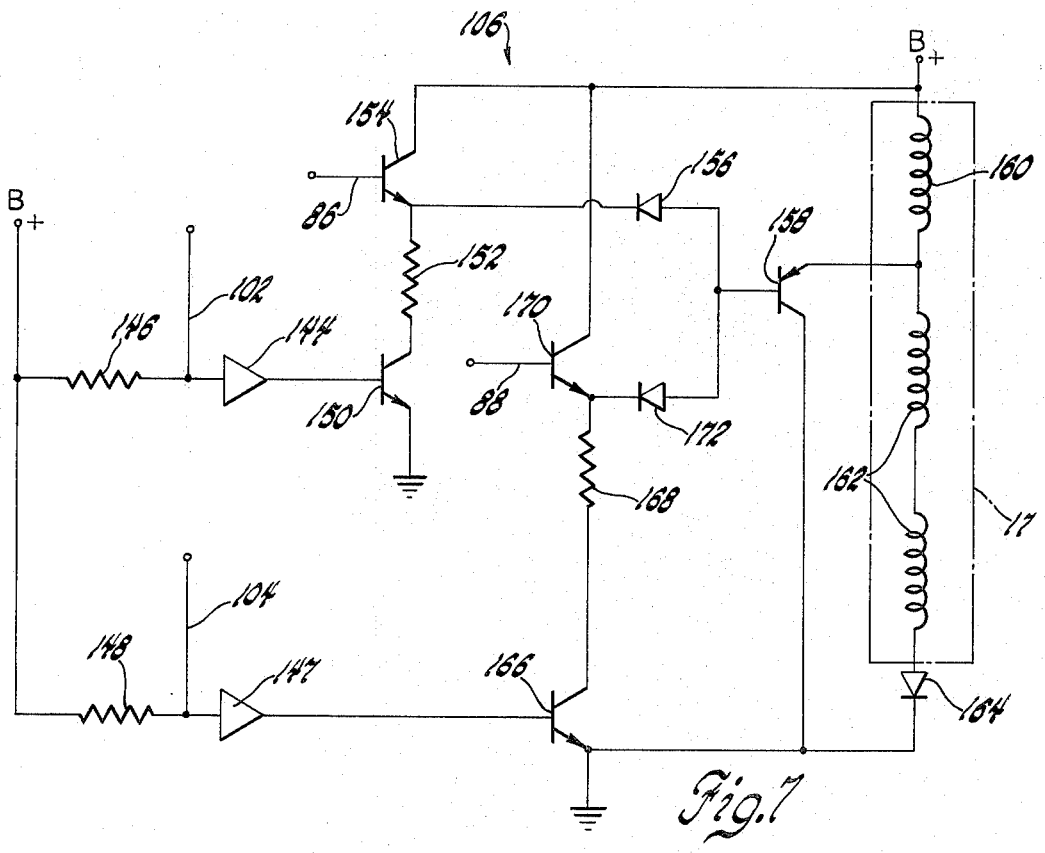
FIG. 7 is a schematic diagram of the sensor select and motor drive circuit of FIG. 5.

The sensor select and meter drive circuit 106 shown in FIG. 7 has an inverter amplifier 144 having its input connected to line 102 and further connected through resistor 146 to B+. Similarly, an inverter amplifier 147 has its input connected to line 104 and through a resistor 148 to B+. The output of inverter 144 is connected to the base of a transistor 150 having a grounded emitter and its collector connected through a resistor 152 to the emitter of a transistor 154. The base of the transistor 154 is connected to line 86 and its collector is connected to B+. The emitter of transistor 154 is further connected through a diode 156 to the base of a transistor 158. The emitter of transistor 158 is connected through a coil 160 of meter 17 to B+ and is further connected through coils 162 of the meter 17 and a diode 164 to ground. The collector of transistor 158 is grounded. The inverter 147 has its output connected to the base of a transistor 166 having a grounded emitter and its collector connected through a resistor 168 to the emitter of a transistor 170. Transistor 170 has its collector connected to B+, the base connected to line 88 and its emitter connected through diode 172 to the base of transistor 158.

Normally, lines 102 and 104 will have a high potential imposed through the resistors 146 and 148, respectively, so that the inverters 144 and 147 will have low outputs and the transistors 150 and 166 will be turned off. Consequentially, transistor 158 will also be nonconductive and the meter movement will be energized to some extreme position so that the meter pointer 16 will be held to some position out of view of the window 12. When, however, switch 72*c* is operated to ground line 102, for example, then the output of the inverter 144 will be high to render the transistor conductive. The signal on line 86 then can modulate the conduction of transistor 154 to vary the potential on the base of the transistor 158 thereby modulating its conduction to effect the current in the coils 160 and 162 to actuate the meter to provide a reading indicative of the condition sensed by sensor 82. Similarly, if the low potential were applied to line 104 instead of line 102, then the signal on line 88 would control the meter reading.

It is obvious that the circuit can be extended to include larger numbers of on/off sensors and their related telltale messages or condition measuring sensor and their corresponding display indicia in accordance with the requirements of the system being monitored. It will be apparent in view of the above description that the system according to this invention does provide in automatic response to measured conditions, meter readings by a single meter at a single display location with indicia appropriate to each condition being measured and further that the meter display is advantgeously incorporated with a telltale display.

The embodiments of the invention in which an exclusive property or privilege is claimed are defined as follows:

1. A multiple indication display to display singly any one of a number of measured conditions comprising means to measure each of said conditions simultaneously and respectively;

elements responsive to each of said means, respectively, when a specific condition attains a predetermined value indicative of abnormality;

a meter having a plurality of indicia operative in conjuncton with said means, respectively, to indicate the value of the individual measurement made by the same, said indicia being selectively displayed in relation to the meter, said meter having a single indicator registerable with the specific one of said indicia which is displayed to indicate the value of said condition, means responsive to an indication of abnormality by one of said elements effective to display the corresponding indicia of said meter and to energize the indicator to effect an indication of the value of the abnormal condition.

2. A multiple indication display to display singly any one of a number of measured conditions comprising means to measure each of said conditions and provide simultaneous signals representing the conditions respectively, detectors responsive to each of said signals, respectively, each to provide an output when its respective signal attains a predetermined value, a meter having an indicator and a plurality of indicia selectively registerable with the indicator to indicate the value of the individual conditions, means responsive to the detector outputs when a particular signal actuates a detector to register the indicia corresponding to the particular signal with the indicator and to energize the meter by the particular signal to effect an indication of the value of the condition represented by the particular signal.

3. A multiple indication display to display singly at a display location any one of a number of sensed events and measured conditions comprising means to measure each of said conditions and provide simultaneous signals representing the conditions respectively, detectors responsive to each of said signals, respectively, each to provide an output when its respective signal attains a predetermined value, a meter having an indicator and a plurality of indicia selectively registerable with the indicator to indicate the value of the individual conditions, on-off sensors to sense each of the events and produce event signals corresponding to the occurrence of each of the events respectively, display means for selectively providing at the display location the said plurality of indicia and a plurality of messages corresponding to the sensed events, respectively, and display actuating means responsive to the detector output when a particular signal actuates a detector to actuate the display means to present the indicia corresponding to the particular signal to the display location in registry with the indicator and to energize the meter by the particular signal to effect an indication of the value of the condition represented by the particular signal, and the display actuating means being further responsive to the event signal upon the occurrence of a particular event to actuate the display means to present to the display location a message corresponding to the sensed event.

4. A multiple indication display to display singly at a display location any one of a number of sensed events and measured conditions comprising means to measure each of said conditions and provide simultaneous signals representing the conditions respectively, detectors responsive to each of said signals, respectively, each to provide an output when its respective signal attains a predetermined value, a meter having an indicator and a plurality of indicia selectively registerable with the indicator to indicate the value of the individual conditions, on-off sensors to sense each of the events and produce event signals corresponding to the occurrence of each of the events respectively, a rotary display carrier having thereon the said plurality of indicia and a plurality of messages corresponding to the sensed events, a motor for rotating the carrier to sequentially and singly present to the display location the indicia and messages, and a display actuating circuit responsive to the detector output when a particular signal actuates a detector to actuate the motor to present the indicia corresponding to the particular signal to the display location in registry with the indicator and to energize the meter by the particular signal to effect an indication of the value of the condition represented by the particular signal, and the display actuating circuit being further responsive to the event signal upon the occurrence of a particular event to actuate the motor to present to the display location a message corresponding to the sensed event.

* * * * *